US011938592B2

(12) United States Patent
Dearborn et al.

(10) Patent No.: US 11,938,592 B2
(45) Date of Patent: Mar. 26, 2024

(54) HIGH-PRESSURE ABRASIVE FLUID INJECTION USING CLEAR FLUID PUMP

(71) Applicant: TD Tools, Inc., Woodburn, KY (US)

(72) Inventors: Earl H. Dearborn, Woodburn, KY (US); Thomas L. Dotson, Woodburn, KY (US); John M. Piercy, Woodburn, KY (US)

(73) Assignee: TD Tools, Inc., Woodburn, KY (US)

( * ) Notice: Subject to any disclaimer, the term of this patent is extended or adjusted under 35 U.S.C. 154(b) by 875 days.

(21) Appl. No.: 17/011,284

(22) Filed: Sep. 3, 2020

(65) Prior Publication Data

US 2021/0069863 A1 Mar. 11, 2021

Related U.S. Application Data

(60) Provisional application No. 62/899,057, filed on Sep. 11, 2019.

(51) Int. Cl.

| | |
|---|---|
| ***B24C 7/00*** | (2006.01) |
| *E21B 43/114* | (2006.01) |
| *E21B 43/26* | (2006.01) |

(52) U.S. Cl.

CPC ..... *B24C 7/0023* (2013.01); *E21B 43/114* (2013.01); *E21B 43/2607* (2020.05)

(58) Field of Classification Search

CPC ... B24C 7/0023; E21B 43/2607; E21B 43/114
USPC ..... 137/14, 15.18, 597; 166/90.1, 75.15, 166/154, 166, 167
See application file for complete search history.

(56) References Cited

U.S. PATENT DOCUMENTS

| | | | | |
|---|---|---|---|---|
| 4,476,897 | A * | 10/1984 | Morrill | E21B 43/013 137/271 |
| 4,711,268 | A * | 12/1987 | Coleman | F16K 11/22 73/756 |
| 5,441,079 | A * | 8/1995 | Zimmerly | F16K 11/22 137/637.2 |
| 5,450,878 | A * | 9/1995 | Zimmerly | F16K 11/22 137/861 |
| 5,469,880 | A * | 11/1995 | Zimmerly | F16K 1/446 137/240 |
| 5,655,560 | A * | 8/1997 | Kedar | B01J 4/02 137/597 |
| 8,925,653 | B2 * | 1/2015 | Dotson | E21B 43/114 166/222 |
| 2003/0196809 | A1 * | 10/2003 | Willberg | C09K 8/685 507/903 |

(Continued)

*Primary Examiner* — Minh Q Le
(74) *Attorney, Agent, or Firm* — Norton Rose Fulbright US LLP

(57) ABSTRACT

Embodiments of this disclosure provide a method and apparatus to inject an abrasive fluid mixture into a high-pressure fluid flow using a clear fluid pump. The high-pressure fluid flow may be used in abrasive jet perforating and hydraulic fracturing applications in oil and gas wells, and other oilfield related work that uses high pressure fluids containing abrasive material. The embodiments include inserting abrasive material downstream of a high-pressure pump, such that a pump without specialized capability for abrasives (e.g., a clear fluid pump) can be used instead of a specialized pump that can withstand abrasives (e.g., hydraulic fracturing pump, oilfield cementing pump).

19 Claims, 7 Drawing Sheets

(56) References Cited

U.S. PATENT DOCUMENTS

| | | | | |
|---|---|---|---|---|
| 2008/0105307 | A1* | 5/2008 | Andoh | F16K 31/122<br>137/495 |
| 2010/0263611 | A1* | 10/2010 | Kenchington | F01L 9/10<br>123/90.12 |
| 2014/0360473 | A1* | 12/2014 | Sturman | F02D 41/3041<br>123/48 AA |
| 2015/0276074 | A1* | 10/2015 | Reilley | B65G 53/60<br>137/597 |
| 2017/0348824 | A1* | 12/2017 | Skross | B24C 1/086 |
| 2023/0193733 | A1* | 6/2023 | Dearborn | G05D 7/0623<br>166/308.1 |

* cited by examiner

HIGH-PRESSURE ABRASIVE FLUID INJECTION USING CLEAR FLUID PUMP

CROSS-REFERENCE TO RELATED PATENT APPLICATIONS

This application claims the benefit of U.S. Provisional Patent Application No. 62/899,057 filed on Sep. 11, 2019 and entitled "High-Pressure Abrasive Fluid Injection," which is hereby incorporated by reference.

FIELD OF THE DISCLOSURE

The instant disclosure relates to hydraulic fracturing and abrasive jet perforating. More specifically, portions of this disclosure relate to injection of abrasive fluid mixture into a high-pressure fluid flow into a well.

BACKGROUND

Hydraulic fracturing operations and abrasive jet perforating and cutting operations require a pressurized flow of abrasive slurry for their processes. However, the pressurization of the abrasive slurry conventionally exposes the high-pressure pump to the abrasive material, which increases maintenance and costs for the operations by adding wear to the high-pressure pump.

SUMMARY

Aspects of the present disclosure provide a high-pressure abrasive pumping process that allows for improved performance and more cost-effective operation by removing sand from the flow through the high-pressure pump by incorporating the sand into the fluid stream on the high-pressure line downstream of the high-pressure pump. By inserting abrasive material downstream of a high-pressure pump, a pump without specialized capability for abrasives (e.g., a clear fluid pump) can be used instead of a specialized pump designed to withstand the abrasives (e.g., a hydraulic fracturing pump or oilfield cementing pump). Costs associated with pumping abrasives can be high due to frequent maintenance required to keep the specialized pumps operating. For example, the abrasives degrade the seats and seals of the pump valves as well as the fluid end of the pump. One advantage of certain embodiments may be a lower system initial and/or maintenance cost during operations involving the delivery of high-pressure abrasive fluids to a destination.

One application of the high-pressure abrasive pumping process according to some embodiments include abrasive jet perforating and hydraulic fracturing in oil and gas wells. Other applications according to different embodiments can include any application involving pumping of abrasives, which can include oilfield-related work that uses high pressure fluids that contain abrasive material, such as cementing, gravel packing, chemical injection, high-pressure cleaning, and other industrial applications. In any of these or other applications, a system that provides a high-pressure abrasive pumping process according to embodiments of this disclosure may be portable and, in some embodiments, mounted to a skid or trailer as a standalone unit or with a pump unit.

According to one embodiment, a modular valve system includes a first valve block having a block of material, the block comprising a fluid channel that extends from a first fluid inlet to a first fluid outlet, and the first valve block further having a valve seat attached to the fluid channel, wherein the valve seat is configured to prevent flow of fluid into the fluid channel when a valve poppet is pressed against the valve seat. The modular valve system may include a second valve block comprising a second fluid inlet and a second fluid outlet with a first piping coupling the first fluid outlet to the second fluid outlet. Additional valve blocks may be combined with the first and second valve blocks and coupled through piping. For example, the valve system may include a third valve block comprising a third fluid inlet and a third fluid outlet, a fourth valve block comprising a fourth fluid inlet and a fourth fluid outlet, second piping coupled to the first fluid inlet and the third fluid inlet, third piping coupled to the third fluid outlet and the fourth fluid outlet, and/or fourth piping coupled to the fourth fluid inlet and the second fluid inlet. The block of material may include a hydraulic cylinder mounting location configured to receive a hydraulic cylinder to press the valve seat against the valve poppet to prevent flow of fluid into the fluid channel.

According to one embodiment, an apparatus may include a hopper, a slurry mixing apparatus coupled to the hopper and configured to mix a low-pressure slurry using material in the hopper, a first high-pressure valve coupled to the slurry mixing apparatus, a second high-pressure valve coupled to the slurry mixing apparatus, a first high-pressure vessel coupled to the slurry mixing apparatus through the first high-pressure valve and the second high-pressure valve, a third high-pressure valve, a high-pressure pump coupled to the first high-pressure vessel through the third high-pressure valve, wherein the high-pressure pump is configured to pressurize the first high-pressure vessel, and a fourth high-pressure valve coupled to the first high-pressure vessel and configured to couple the first high-pressure vessel to a destination. The apparatus may use a modular valve block disclosed in embodiments of this disclosure, in which the modular valve block includes the first high-pressure valve, the second high-pressure valve, the third high-pressure valve, and the fourth high-pressure valve. In some embodiments, the apparatus may include a fifth high-pressure valve coupled to the high-pressure pump and coupled to a bypass line for transporting clear fluid around the first high-pressure vessel. In some embodiments, the apparatus may include a second high-pressure vessel in parallel with the first high-pressure vessel and coupled to the first high-pressure valve, the second high-pressure valve, the third high-pressure valve, and the fourth high-pressure valve. In some embodiments, the apparatus may include a second high-pressure vessel, a fifth high-pressure valve coupled to the second high-pressure vessel and coupled to slurry mixing apparatus, a sixth high-pressure valve coupled to the second high-pressure vessel and coupled to slurry mixing apparatus, a seventh high-pressure valve coupled to the second high-pressure vessel and coupled to the high-pressure pump, and an eighth high-pressure valve coupled to the second high-pressure vessel. The apparatus may include a controller for operating the first high-pressure valve, the second high-pressure valve, the third high-pressure valve, and the fourth high-pressure valve, such as by controlling a plurality of hydraulically-actuated cylinders coupled to valve seats in valve blocks of a modular valve system to operate the first high-pressure valve, the second high-pressure valve, the third high-pressure valve, and the fourth high-pressure valve.

According to one embodiment, a method includes opening a first high-pressure valve and a second high-pressure valve to create a path for circulating abrasive slurry from a slurry-mixing apparatus to a first high-pressure vessel, closing a third high-pressure valve and a fourth high-pressure valve to disconnect the first high-pressure vessel from a high-pressure non-abrasive pump, closing the first high-pressure valve and the second high-pressure valve to disconnect the first high-pressure vessel from the slurry-mixing apparatus, and opening the third high-pressure valve and the fourth high-pressure valve to allow the high-pressure non-abrasive pump to use high-pressure non-abrasive fluid to push the abrasive slurry through the first high-pressure vessel to a destination. In some embodiments, the method may include opening a fifth high-pressure valve to direct the high-pressure non-abrasive fluid to the destination through a bypass path around the first high-pressure vessel, wherein the opening of the fifth high-pressure valve is before closing the third high-pressure valve and the fourth high-pressure valve and closing a fifth high-pressure valve to disconnect the bypass path from the high-pressure non-abrasive pump after opening the third high-pressure valve and the fourth high-pressure valve. In some embodiments, the opening of the first high-pressure valve and the second high-pressure valve also circulates low-pressure abrasive slurry from a slurry-mixing apparatus to a second high-pressure vessel coupled in parallel with the first high-pressure vessel.

In some embodiments, the method may operate a second high-pressure vessel in alternation with the first high-pressure vessel. In such an embodiment, the method may also include opening a fifth high-pressure valve and a sixth high-pressure valve, each coupled to the second high-pressure vessel and coupled to the slurry mixing apparatus, to create a path for circulating abrasive slurry from the slurry-mixing apparatus to the second high-pressure vessel, closing a seventh high-pressure valve and an eighth high-pressure valve, each coupled to the second high-pressure vessel and coupled to the high-pressure non-abrasive pump, to disconnect the second high-pressure vessel from the high-pressure non-abrasive pump, closing the fifth high-pressure valve and the sixth high-pressure valve to disconnect the second high-pressure vessel from the slurry-mixing apparatus, and opening the seventh high-pressure valve and the eighth high-pressure valve to allow the high-pressure non-abrasive pump to use high-pressure non-abrasive fluid to push the abrasive slurry through the second high-pressure vessel to the destination.

The valves corresponding to the second high-pressure vessel may be controlled to maintain a continuous flow of high-pressure fluid to the destination. For example, in some embodiments the method may include opening of the seventh high-pressure valve and the eighth high-pressure valve is before closing the third high-pressure valve and the fourth high-pressure valve to maintain the continuous flow to the destination. In embodiments with a bypass path, the valve corresponding to the bypass path may be opened before closing valves that coupled the high-pressure non-abrasive pump to the destination through the first high-pressure vessel.

According to one embodiment, a system includes an abrasives storage container, a slurry mixing apparatus, a first high pressure vessel fluidly connected to the slurry mixing apparatus through a first high pressure inlet valve and a second high pressure outlet valve, a high pressure pump fluidly connected to the first high pressure vessel through a third high-pressure inlet valve and a fourth high pressure outlet valve, wherein the high pressure is configured to pressurize the first high pressure vessel, a fifth high pressure valve connected to the high-pressure pump line through a tee. The high-pressure pump line may continue to another tee allowing clear pressurized fluid to bypass the high-pressure cylinder, in certain embodiments or a in a configured time, and a wellbore connected to the first high-pressure vessel through a third high-pressure valve.

According to another embodiment, a method may include: mixing abrasive slurry under low pressure by the abrasive mixing apparatus with sand from a sand hopper; circulating the low-pressure abrasive slurry from the slurry mixing apparatus through a first high-pressure valve, through a first high-pressure vessel, through a second high-pressure valve, and back to the slurry mixing apparatus; closing a third high-pressure valve and a fourth high-pressure valve; sending high-pressure non-abrasive fluid by a high-pressure pump through a fifth high-pressure valve to the wellbore, by bypassing a first high-pressure vessel; closing the first high-pressure valve and second high-pressure valve to stop the low-pressure flow of abrasive slurry; opening a third high-pressure valve and fourth high-pressure valve to allow high-pressure fluid to begin to push the abrasive slurry through the first high-pressure vessel to a wellbore; closing a fifth high-pressure valve to stop flow of the high-pressure fluid through the bypass; pushing the abrasive fluid through the high-pressure vessel into the wellbore; opening a fifth high-pressure valve to allow flow of the high-pressure fluid through the bypass; closing a third and fourth high-pressure valve to stop high-pressure fluid from flowing through a high-pressure vessel; and opening a first and second high-pressure vessel to allow the low-pressure abrasive slurry to circulate through a first high-pressure vessel.

According to another embodiment, a method of operating a fluid injection system, during jet perforating or fracturing, may include opening a first high-pressure valve and a second high-pressure valve to circulate low-pressure abrasive slurry from a slurry-mixing apparatus through a first high-pressure vessel, a second high-pressure vessel, and back to the slurry-mixing apparatus; closing a third high-pressure valve and a fourth high-pressure valve to send high-pressure non-abrasive fluid through a fifth high-pressure valve to a wellbore by bypassing the first high-pressure vessel; closing the first high-pressure valve and the second high-pressure valve to stop low-pressure flow of abrasive slurry; opening the third high-pressure valve and the fourth high-pressure valve to allow high-pressure fluid to push the abrasive fluid through the first high-pressure vessel to the wellbore; and closing a fifth high-pressure valve to stop flow of the high-pressure fluid through a bypass around the first high-pressure vessel.

According to another embodiment, a valve system, which may be used in the high-pressure abrasive fluid injection system and method described above, or other systems or methods, may include two or more individual valves connected by pressure-rated piping, which may be configured to take the place of a one-piece fluid manifold. In certain embodiments, the valve system may include at least one block of material that has the tensile and yield strength required to withstand high-pressure fluid inside internal fluid channels and resists abrasive wear, in which the block includes at least one internal fluid channel that contains a valve seat or a sleeve or other type of inserted material that contains a valve seat, and in which the block includes a front face with mounting holes to attach a hydraulic cylinder with rod, in which the rod will have a valve poppet that will match the valve seat in a way that when pressed together prevents the flow of fluid, even pressurized fluid, from passing across, in which each end of the flow path through the valve with have a machined connection port to allow the connection of piping that can be sealed to prevent leakage under pressure. In some embodiments, the block of material may include one or more of steel, alloy steel, exotic metals, carbon fiber. In some embodiments, the piping is sealed using one or more of a flange face, O-ring boss, or pipe threads.

In some embodiments, the valve seat should also have appropriate strength characteristics and abrasive resistant properties, and may include one or more of a steel alloy, hardened steel, heat treated alloy, silicon nitride, carbide, tungsten carbide, boron carbide, or coatings.

In some embodiments, the valve poppet and seat assembly either stop the flow of fluid when closed or allow the flow of fluid when open.

In some embodiments, the valve is bi-directional in that fluid can flow through it in either direction.

According to one embodiment, a method of operating the valve system includes, in its "home" position, retracting the hydraulic cylinder rod to create space between the valve poppet and valve seat to allow fluid flow; closing the valve to prevent fluid from flowing by actuating the hydraulic cylinder; and controlling fluid through the valve (and piping connected to it) by the actuation of the hydraulic valve.

As used herein, "coupling" of two components through which fluid flows, such as components including pipes, fluid channels, vessels, tanks, hoppers, valves, and pumps, refers to fluidly connecting the two components such that fluid may flow from one component to another component with generally no loss of fluid, such as less than 5% or less than 1% of fluid, as the fluid traverses from one component to the other component.

As used herein, "coupling" of electronic devices, such as a controller to an electronically controlled valve, refers to electrically coupling the two components such that electrical signals may be transmitted and/or received between the two components. Such "coupling" of electronic devices may include coupling through other components, including active components such as repeaters and passive components such as resistors.

As used herein, "disconnecting" of two components terminates a path created by coupling of the same two components.

As used herein, "clear fluid" refers to any fluid without inserted abrasive materials. One example of a "clear fluid" is water, which can be transparent, but transparency is not a required characteristic of a "clear fluid."

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Embodiments of this disclosure provide a method and apparatus to inject an abrasive fluid mixture into a high-pressure fluid flow. Embodiments of the disclosure may be used in applications such as abrasive jet perforating and hydraulic fracturing in oil and gas wells, and also other oilfield related work that uses high pressure fluids that contain abrasive material, such as cementing, gravel packing, and chemical injection, high-pressure cleaning, and other industrial applications. By inserting abrasive material downstream of a high-pressure pump, a pump without specialized capability for abrasives (e.g., a clear fluid pump) can be used instead of a specialized pump that can withstand abrasives (e.g., hydraulic fracturing pump, oilfield cementing pump). Costs associated with pumping abrasives can be high due to the frequent maintenance required to keep specialized pumps functional. The abrasive degrades the seats and seals of the pump valves as well as the fluid end of the pump. Thus, one advantage of certain embodiments may be a lower system initial and maintenance cost. In some embodiments, the system is portable and can be mounted to a skid or trailer as a standalone unit or with a pump unit.

Fluid Injection System

Figure 1:
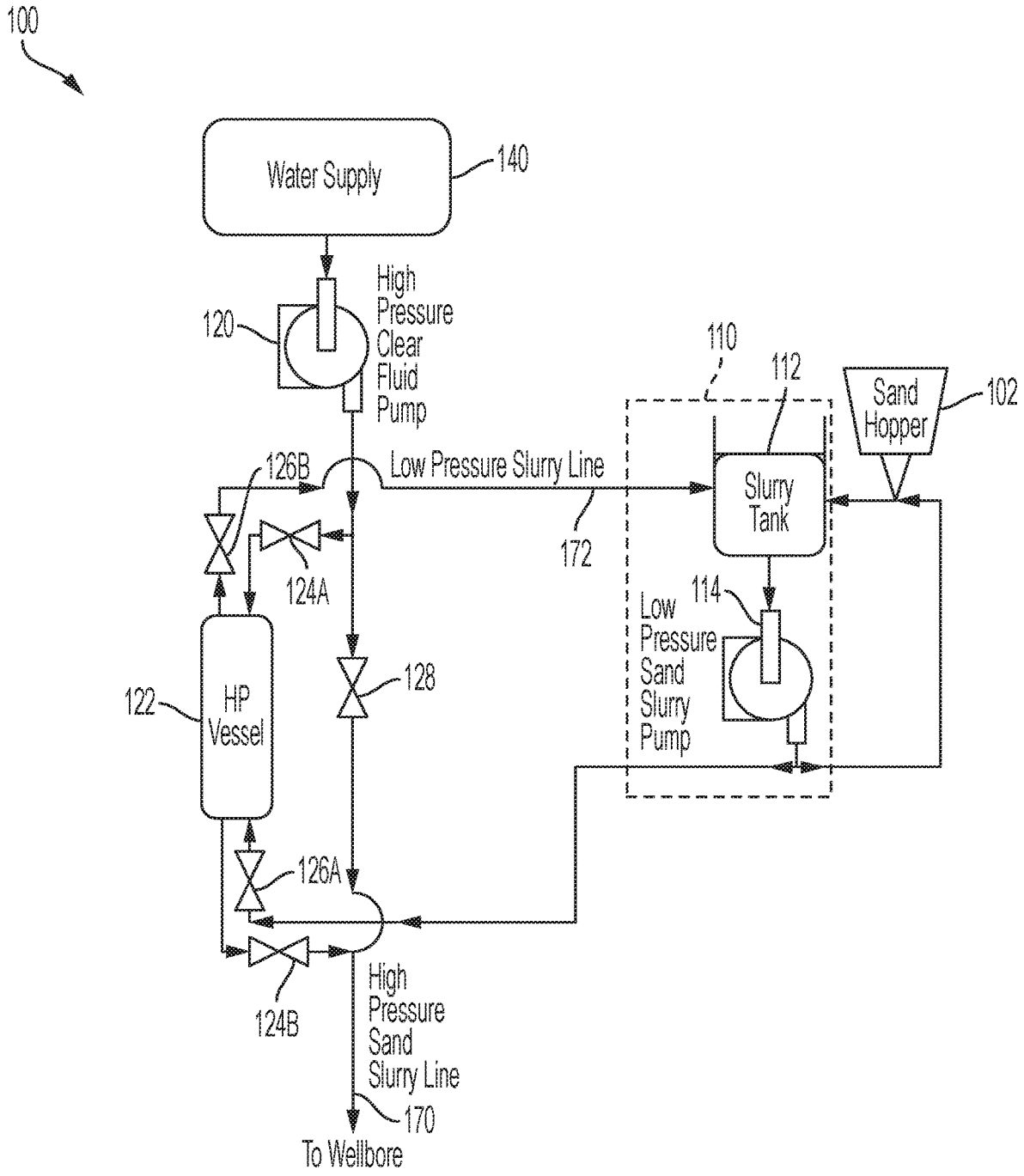
FIG. 1 shows a fluid injection system according to some embodiments of the disclosure.

FIG. 1 shows a fluid injection according to some embodiments of the disclosure. The system 100 may include an abrasives storage container 102, such as a sand hopper. The system may also include a slurry mixing apparatus 110 coupled to the abrasives storage container 102 and configured to receive abrasives, such as sand, from the container 102. The slurry mixing apparatus 110 may include a slurry container 112 (e.g., tank) in which abrasive (e.g., dry sand) is mixed with a fluid (e.g., water) and/or other chemicals. The slurry mixing apparatus 110 may also include a low-pressure abrasive pump 114 coupled to the slurry container 112. The low-pressure abrasive pump 114 is configured to withstand abrasives, such as by including abrasive-resistant materials.

The system 100 may also include a high-pressure pump 120 coupled to a first high-pressure vessel 122 through a high-pressure inlet valve 124A and a high-pressure outlet valve 124B. The high-pressure pump 120 is configured to pressurize the first high pressure vessel 122. The high-pressure pump 120 may not include abrasive-resistant materials because little to no abrasive reaches the high-pressure pump 120. Such a high-pressure pump may be referred to as a high-pressure clear fluid pump.

A low-pressure slurry line 172 couples the first high-pressure vessel 122 to the slurry mixing apparatus 110. Slurry may be mixed by the slurry mixing apparatus 110 and injected into the low-pressure slurry line 172, from which the low-pressure abrasive pump 114 moves the slurry into the high-pressure vessel 122. The low-pressure slurry line 172 couples to the high-pressure vessel 122 through a valve 126A, a high-pressure inlet valve, and a valve 126B, a high-pressure outlet valve. In some applications, a wellbore, or other destination, at the end of line 170 is coupled to the first high-pressure vessel 122 through a valve 124B.

The system 100 may further include a bypass path for high-pressure fluid exiting the high-pressure pump 120 around the high-pressure vessel 122. The bypass path may include a fifth valve 128, a high-pressure valve. The valve 128 may be coupled to a high-pressure pump line 170 through a first tee at the inlet to the high-pressure vessel 122 that also couples to the valve 124A. The line 170 continues to a second tee at the outlet of the high-pressure vessel 122 that also couples to the valve 124B, which allows clear, pressurized fluid to bypass the high-pressure vessel 122, when desired. The bypass path may be activated, in some embodiments, to maintain a continuous flow of high-pressure fluid through high-pressure line 170 to the destination. For example, during injection of low-pressure slurry into the high-pressure vessel 122, the high-pressure clear fluid may be directed along the bypass path.

Figure 2:
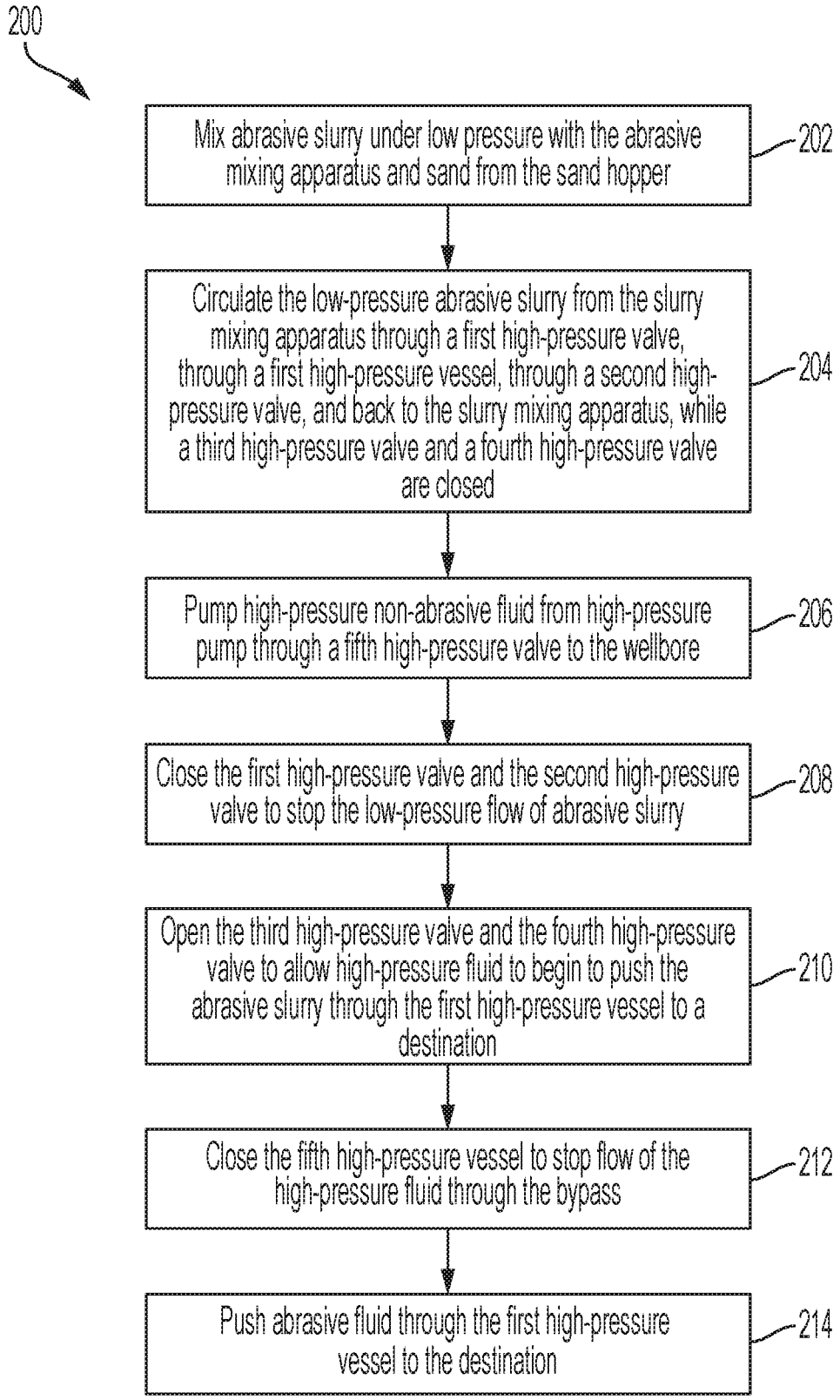
FIG. 2 shows a flow chart for fluid injection according to some embodiments of the disclosure.

The system of FIG. 1 may be operated to control the flow of abrasive fluid by controlling operation of the pumps 114 and 120 and the valves 124A, 124B, 126A, 126B, and 128. One example method of operation for the system of FIG. 1 is described with reference to FIG. 2. FIG. 2 shows a flow chart for fluid injection according to some embodiments of the disclosure. A method 200 of operation may include, at block 202, mixing abrasive slurry under low pressure by the abrasive mixing apparatus 110 with sand from the sand hopper 102. The mixing of block 202 may occur continuously throughout operation involving the high-pressure vessel, or the mixing may be operated at periodic intervals to obtain and store slurry until used to inject into the first high-pressure vessel.

At block 204, the low-pressure abrasive slurry is circulated from the slurry mixing apparatus 110 through the first high-pressure valve 126A, through the first high-pressure vessel 122, through the second high-pressure valve 126B, and back to the slurry mixing apparatus 110. The circulation results in the depositing of abrasive slurry into the first high-pressure vessel 122. The third high-pressure valve 124A and the fourth-high pressure valve 124B may be closed during this operation to prevent backflow of high-pressure fluid to the low-pressure pump.

At block 206, high-pressure non-abrasive fluid (such as water) is transferred from the reservoir 140 by the high-pressure pump 120 through the fifth high pressure valve 128 to a wellbore, bypassing the first high-pressure vessel 122. Block 206 may be performed in parallel with block 204. If, for example, continuous flow of high-pressure fluid is not desired to the wellbore, the method may allow for the shut-down of the high-pressure pump during injection of the low-pressure abrasive slurry into the first high-pressure vessel, instead of configuring the high-pressure fluid to bypass the high-pressure vessel 122 at block 206 while the low-pressure abrasive slurry is circulated into the first high-pressure vessel at block 204.

When one or more criteria are met, the filling of abrasive slurry into the first high-pressure vessel may be terminated. At block 208, the first high-pressure valve 126A and the second high-pressure valve 126B are closed to stop the low-pressure flow of abrasive slurry into the high-pressure vessel 122.

At block 210, the third high-pressure valve 124A and the fourth high-pressure valve 124B are opened to allow high-pressure non-abrasive fluid to begin to push the abrasive slurry through the first high-pressure vessel 122 to a destination, such as a wellbore. The non-abrasive fluid mixes with the abrasive slurry in the first high-pressure vessel 122 to obtain a desired abrasive fluid concentration in a slurry mix, wherein the concentration of abrasive content in the slurry mix can be controlled by controller amount of abrasive slurry in the high-pressure vessel 122, the pressure of non-abrasive fluid output from the high-pressure pump 120, and other criteria. The third and fourth high-pressure valves 124A, 124B may not be opened until after the first and second high-pressure valves 126A, 126B are closed to prevent backflow of high-pressure fluid into the slurry mixing apparatus.

At block 212, the fifth high-pressure valve 128 is closed to stop flow of the high-pressure fluid through the bypass. The closing of the bypass path at block 212 may be performed in parallel with block 210 or after the opening of the third and fourth high-pressure valves 124A-B.

At block 214, the opening of the third and fourth valves 124A, 124B allow the slurry mix to be output from the high-pressure vessel 122 using the high-pressure pump 120 into the wellbore or other destination.

When one or more criteria are met, the injection to the wellbore may be terminated. For example, when a predetermined amount of low-pressure abrasive slurry is consumed or a predetermined time of injecting into the wellbore completes, the high-pressure vessel may be disconnected from the wellbore. The fifth high-pressure valve 128 is opened to allow flow of the high-pressure fluid through the bypass. Then, a third high-pressure valve 124A and fourth high-pressure valve 124B are closed to disconnect the high-pressure pump 120 from the high-pressure vessel 122, which stops the high-pressure fluid from flowing through the high-pressure vessel 122.

Figure 3A:
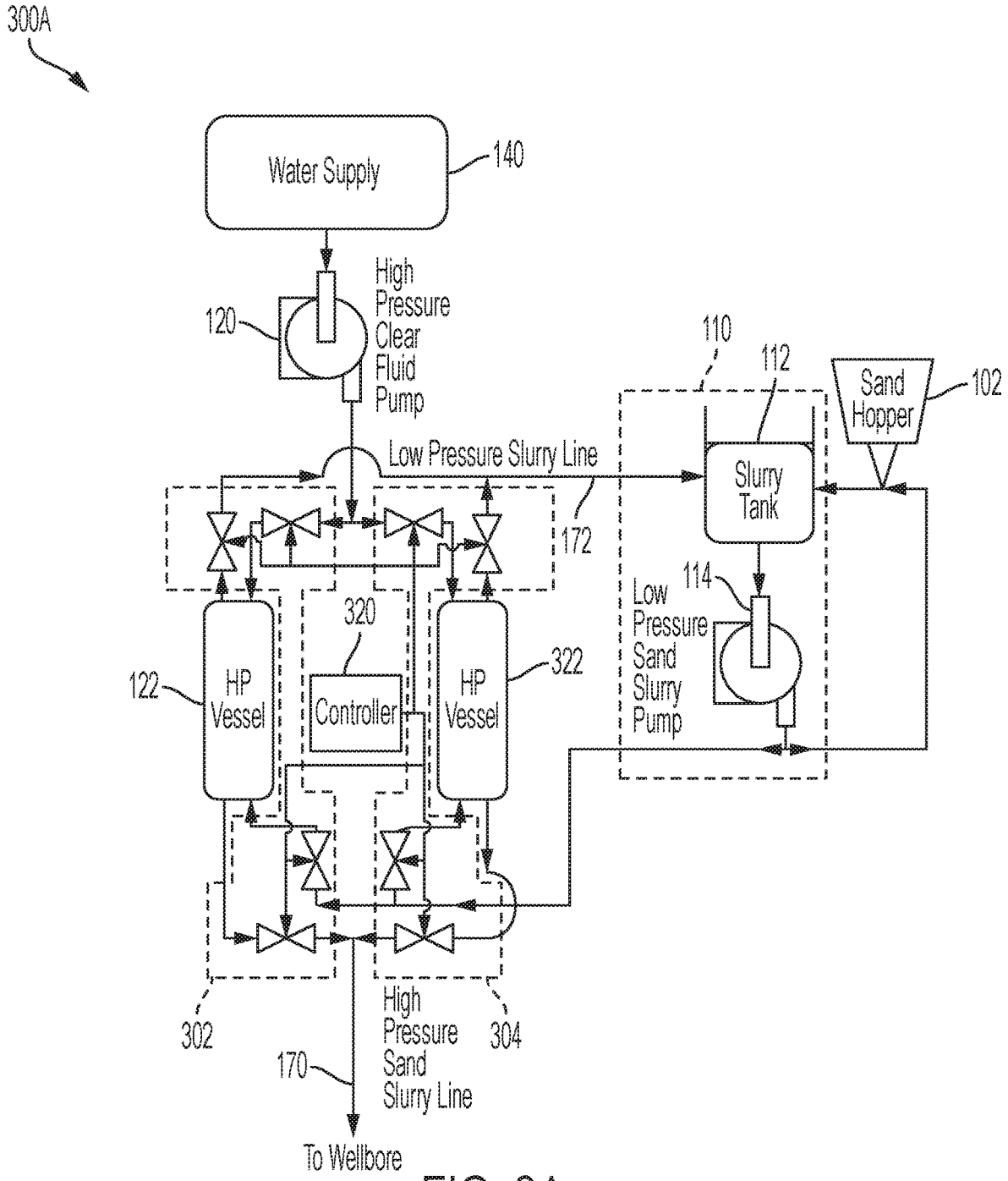
FIG. 3A shows a fluid injection system with a plurality of sets of valves according to some embodiments of the disclosure.

The embodiment of FIG. 2 illustrates a method for using a set of four valves 124A, 124B, 126A, and 126B to control the application of a high-pressure abrasive mix to a wellbore or other destination. Additional sets of four valves may be used to couple other high-pressure vessels in the system for applying a high-pressure slurry mix to a destination. FIG. 3A shows a fluid injection system with two sets of valves for two high-pressure vessels according to some embodiments of the disclosure. Two sets of valves and two high-pressure vessels are described with reference to FIG. 3A, however more sets of valves and/or high-pressure vessels may be used.

Two sets of valves are shown as set 302 and 304, and each may include a set of valves configured similarly to that shown for valves 124A, 124B, 126A, and 126B of FIG. 1, but for two high-pressure vessels 122 and 322. A first set 302 of four valves couples high-pressure vessels 122 to the high-pressure clear fluid pump 120 and the slurry mixing apparatus 110. The second set 304 of four valves couples the second high-pressure vessel 322 to the high-pressure clear fluid pump 120 and the slurry mixing apparatus 110. In some embodiments, each of the sets 302 and 304 of four valves may be implemented in a valve manifold. In other embodiments, the valves may be implemented in a modular valve system described in more detail below, such as described below in embodiments illustrated in FIG. 5 and FIG. 6.

A controller 320 may be coupled to one or more of the valves in the sets of valves 302 and 304 to automate control of the valves according to a set of preprogrammed conditions, desired flowrate, and/or desired slurry concentration. The controller 320 may implement a set of rules configured for the application of the high-pressure sand slurry to the wellbore or other destination. The controller 320 may include logic circuitry for determining when to open or close each of the valves in the sets of valves 302 and 304. The logic circuitry may implement a state machine to determine when to switch between, for example, a first state corresponding to block 202 of FIG. 2, a second state corresponding to block 204 of FIG. 2, a third state corresponding to block 206 of FIG. 2, a fourth state corresponding to block 208 of FIG. 2, a fifth state corresponding to block 210 of FIG. 2, a sixth state corresponding to block 212 of FIG. 2, and a seventh state corresponding to block 214 of FIG. 2.

Figure 3B:
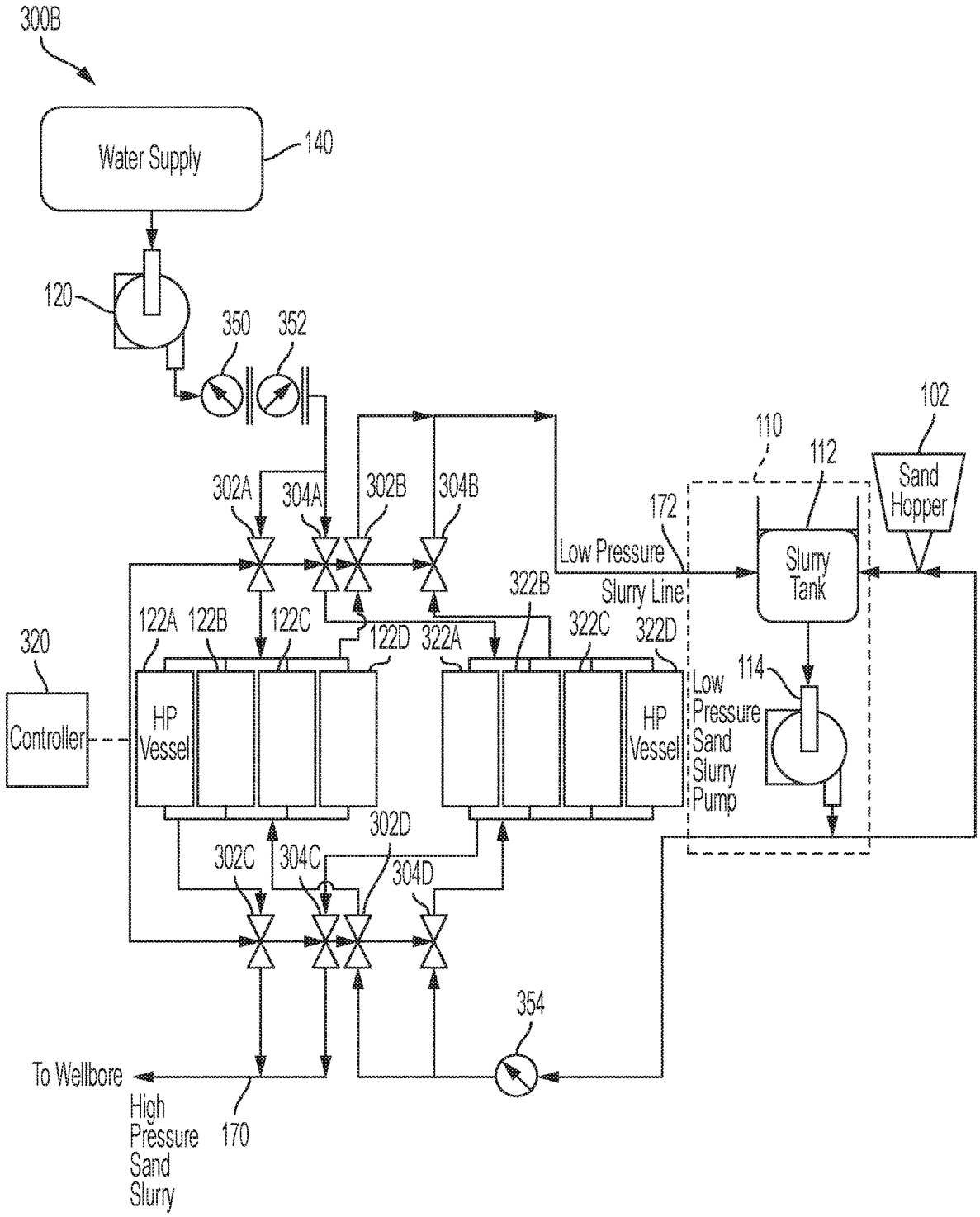
FIG. 3B shows a fluid injection system with a plurality of high-pressure vessels in parallel according to some embodiments of the disclosure.

The system 300A of FIG. 3A includes two sets of four valves. However, more sets of valves and/or high-pressure vessels may be used. One embodiment with multiple high-pressure vessels is shown in FIG. 3B. FIG. 3B shows a fluid injection system with a plurality of high-pressure vessels in parallel according to some embodiments of the disclosure. The system 300B of FIG. 3B is similar to the system 300A of FIG. 3A, but includes multiple high-pressure vessels 122A-D coupled to the first set 302 of valves 302A-D. The system 300B also includes multiple high-pressure vessels 322A-D coupled to the second set 304 of valves 304A-D. Although an equal number of high-pressure vessels is shown coupled to each of the sets 302, 304 of valves, some embodiments may include a different number of high-pressure vessels coupled to the sets 302, 304 of valves. Multiple high-pressure vessels 122A-D and 322A-D as in the system 300B may allow smaller inner diameter vessels to be used while obtaining the desired output flow of high-pressure slurry. The use of smaller inner diameter vessels may reduce the cost of the system 300B in comparison to a similar system with fewer, larger diameter vessels.

In some embodiments, regardless of number of sets of valves or number of high-pressure vessels, the controller 320 may use inputs for determining when to transition to the first state, second state, and/or other states of the state machine. The inputs may be obtained from one or more sensors, timers, or user inputs. Example sensors include a pressure transducer 350 coupled at an output of the high-pressure pump 120, flowmeter 352 coupled to an output of the high-pressure pump 120, and/or pressure transducer 354 coupled to the low-pressure slurry line, such as at an output of the low-pressure.

Figure 4:
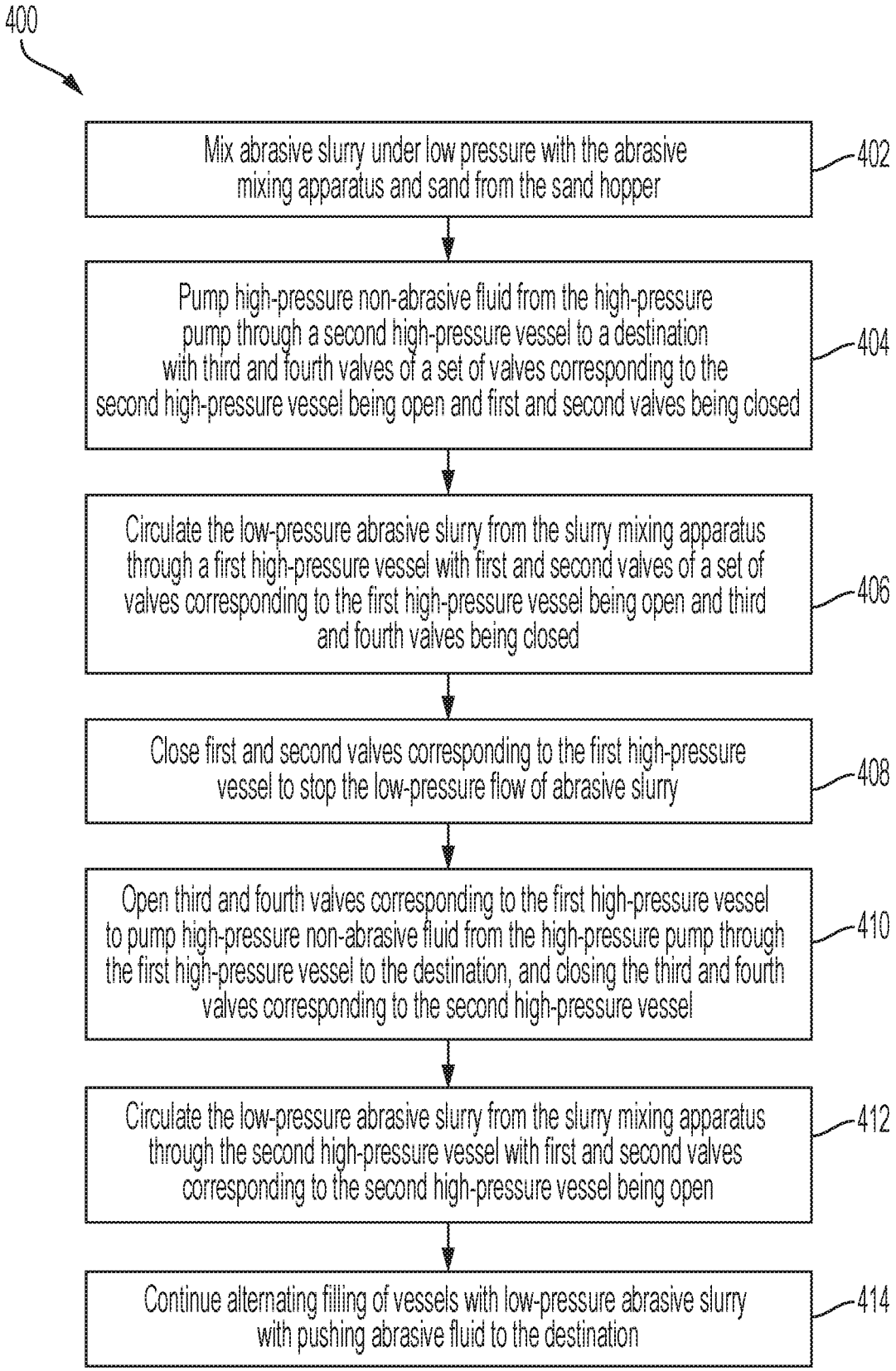
FIG. 4 shows a flow chart for fluid injection with multiple high-pressure vessels according to some embodiments of the disclosure.

FIG. 4 shows a flow chart for fluid injection with multiple high-pressure vessels according to some embodiments of the disclosure. A method 400 includes, at block 402, mixing abrasive slurry under low pressure with the abrasive mixing apparatus and sand from the sand hopper. The mixing of block 402 may continue throughout operation of the method 400 or portions of the method 400 and used to supply low-pressure slurry to the high-pressure vessels.

At block 404, high-pressure non-abrasive fluid is pumped by the high-pressure pump through a second high-pressure vessel to a destination with third and fourth valves of a set of valves corresponding to the second high-pressure vessel being open and first and second valves of the same set of valves being closed. For example, referring to FIG. 3B, the valves 304A and 304C may be open to provide a path for high-pressure fluid to the destination. The valves 304B and 304D are closed such that the first one or more high-pressure vessels 122A-D can be filled with low-pressure slurry.

At block 406, the low-pressure slurry is circulated from the slurry mixing apparatus through one or more first high-pressure vessels 122A-D using first and second valves of a set of valves corresponding to the first high-pressure vessel being open and third and fourth valves of the same set being closed. For example, referring to FIG. 3B, the valves 302B and 302D are open and the valves 302A and 302C are closed. Block 406 may be performed in parallel with block 404.

At block 408, first and second valves corresponding to one or more first high-pressure vessel are closed to stop the low-pressure flow of abrasive slurry into the first vessels. This may occur after the desired amount of slurry has filled the first vessels to obtain the desired concentration of high-pressure mix output from the vessels. For example, referring to FIG. 3B, the valves 302B and 302D are closed.

At block 410, third and fourth valves corresponding to the first one or more high-pressure vessels are opened to pump high-pressure non-abrasive fluid from the high-pressure pump through the first one or more high-pressure vessels to the destination, while the third and fourth valves corresponding to the second one or more high-pressure vessels are closed. For example, referring to FIG. 3B, the valves 302A and 302C are opened. Block 410 may be performed only after the closing of the valves of block 408 are complete to prevent backflow of high-pressure fluid into the slurry mixing apparatus.

At block 412, low-pressure abrasive slurry is circulated from the slurry mixing apparatus through the second one or more high-pressure vessels with first and second valves corresponding to the second high-pressure vessels being open. For example, referring to FIG. 3B, the valves 304B and 304D are opened to create a path for low-pressure slurry into the second high-pressure vessels 322A-D. The valves 304A and 304C may be closed during injection of the low-pressure slurry into the vessels 322A-D. Block 412 may be performed after high-pressure fluid is passing through the first high-pressure vessel to the destination, such that the depositing of abrasive slurry into the second high-pressure vessel is performed in parallel with the emptying of the first high-pressure vessel.

At block 414, the method 300 may continue with alternating filling of vessels with low-pressure abrasive slurry and with pushing abrasive fluid to the destination. For example, referring to FIG. 3B, the first high-pressure vessels 122A-D may be filled with slurry while the second high-pressure vessels 322A-D are used to push high-pressure abrasive fluids to the destination. When the concentration of abrasive slurry falls below a certain threshold, the controller 320 may control the switches as described above in blocks 404-412 to configure the low-pressure line and high-pressure line for injecting low-pressure abrasive slurry into the high-pressure vessels 322A-D while the first high-pressure vessels 122A-D are used to push high-pressure abrasive fluids to the destination.

In some embodiments, systems with multiple sets of valves and/or multiple high-pressure vessels, such as shown in FIG. 3A and FIG. 3B, may include a bypass valve and line such as shown in FIG. 1. The bypass valve allows clear fluid to be pumped by the high-pressure pump to a wellbore or other destination without passing through the high-pressure vessel. The bypass valve and line may provide greater flexibility in operation of the systems 300A, B, such as when a problem occurs.

Other embodiments may implement different configurations than those described in FIG. 1, FIG. 3A, and FIG. 3B while still providing injection of an abrasive fluid mixture into a high-pressure fluid flow. For example, in some embodiments, the high-pressure vessels may be oriented in positions having angles with respect to a vertical position from the ground or oriented in a vertical position such that the sand in the slurry would tend to fall to an outflow side of the high-pressure vessel. Such a configuration may reduce the likelihood of the flow through the high-pressure vessel bypassing some of the slurry mixture. The vessels 122, 322 may take various shapes based on performance needs. In one embodiment, the vessels 122, 322 may be cylinders. Further, a variety of different valve and pressure vessel configurations could be used in the injection system. The valves can also be actuated at different times or in a different sequence to achieve specific desired results. A computer, mobile device, or other electronic device may be used as a controller 320 to adjust the timing and sequence of opening and closing of the valves based on flow and desired abrasive concentration.

One advantage of the fluid injection systems according to embodiments of this disclosure is that having high-pressure vessels with multiple ports on each end reduces wear from abrasive by distributing that wear. Further, the embodiments may create more efficient flow for the abrasive or chemical being introduced. The more efficient flow can include better distribution of introduced material with no combined material flow to separate before the fluid stream enters the high-pressure vessel or after the fluid stream exits the high-pressure vessel.

Another advantage of the fluid injection systems according to embodiments of this disclosure is that multiple sets of high-pressure vessels can create greater combined flow suitable for higher flow applications, like hydraulic fracturing. Each modular pair of vessels and valves contribute to a greater overall flow.

Another advantage of the fluid injection systems according to embodiments of this disclosure is that having singular valves working separately or together create a greater flexibility for the system. As pressure requirements increase (e.g., from 5,000 psi to 10,000 psi to 15,000 psi), combined flow manifolds also increase in size. This size can become large enough that the blocks of material become difficult to obtain or must be custom forged. Using individual valves create smaller blocks to build that can readily be found at material suppliers. This decreases cost and construction time of the valve systems. Individual valves are also lighter and easier to mount.

Another advantage of the fluid injection systems according to embodiments of this disclosure is that use of individual valves can allow them to be placed in different locations to streamline construction of the equipment. For example, the valves could be remotely mounted to the low-pressure slurry feed or low-pressure water line back to the slurry tank. This would use less piping by not requiring the fluid to flow to a centrally located manifold creating a more efficient piping layout that increases performance (by reducing wear) and is more cost effective (by reducing total piping length). The high-pressure slurry output or water feed lines could also benefit from these remote valves.

Modular Valve System

In fluid injection systems, such as embodiments of a system described above, a valve manifold may be used. In some embodiments, the valve manifold may be replaced by a modular valve system. The modular valve system may be easier to handle, less expensive to manufacture, and provide more scalability than a valve manifold. In one example of a modular valve system, four individual valves may be coupled by pressure rated piping to take the place of a one-piece fluid manifold. Additional details regarding the fluid manifold are described with reference to FIG. 5 and FIG. 6.

Figure 5:
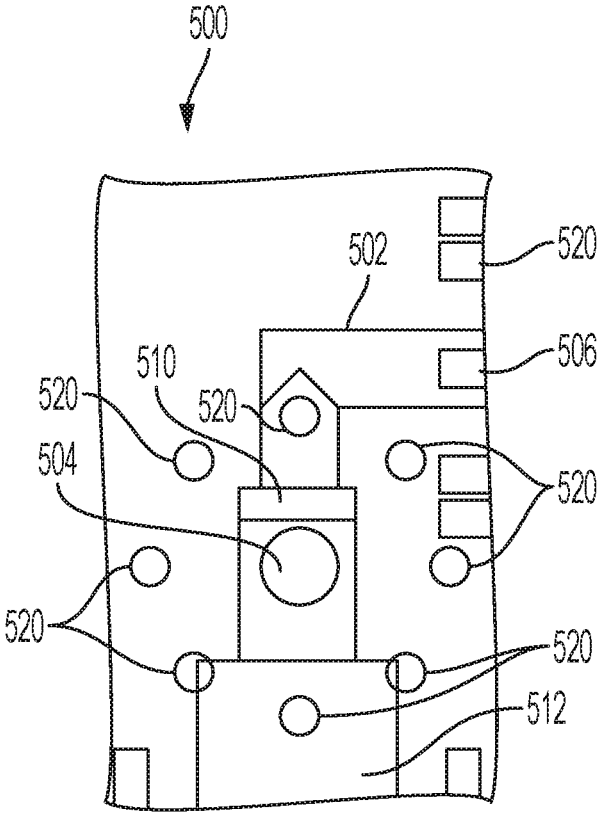
FIG. 5 shows a top-down view through a block used as a valve according to embodiments of the disclosure.

FIG. 5 shows a top-down view through a block used as a valve according to embodiments of the disclosure. The valve block 500 includes a fluid channel 502 extending from a fluid inlet 504 to a fluid outlet 506. A valve seat 510 is located between the fluid inlet 504 and the fluid outlet 506. The block 500 includes a hydraulic cylinder mounting location 512 configured such that a hydraulic cylinder can operate the valve seat 510 to allow or interrupt fluid flow through the fluid channel 502. The block 500 may also include mounting holes 520 configured to receive piping flanges that may couple the block 500 to other blocks.

The operation of an individual valve may include beginning in a home position, in which the hydraulic cylinder rod is retracted, creating space between the valve poppet and valve seat. This position allows fluid flow by opening the valve. When the valve needs to be closed to prevent fluid from flowing through, the hydraulic cylinder is actuated. This actuation forces the valve poppet against the valve seat, preventing any fluid from flowing through the channel 502. In this configuration, the valve is closed. With the block 500, fluid through this valve (and piping coupled thereto) may be controlled by the actuation of the hydraulic valve to operate the bi-directional valve seat. A controller, such as those illustrated in FIG. 3A and FIG. 3B, may be coupled to the hydraulic valve to operate the valve between open and closed states.

In certain embodiments, the block 500 may be made of material that has a tensile and yield strength required to withstand high-pressure fluid inside internal fluid channels, such as channel 502, and that resists abrasive wear. Example materials for the block 500 include steel, alloy steel, exotic metals, carbon fiber, or a combination thereof. The valve block 500 may include at least one internal fluid channel that contains a valve seat or a sleeve or other type of inserted material that contains a valve seat. The seat or sleeve, or another aspect of the block, can have appropriate strength characteristics and abrasive resistant properties. Example materials for the seat include steel alloy, hardened steel, heat treated alloy, silicon nitride, carbide, tungsten carbide, boron carbide, and/or other coatings. The valve has a front face with mounting holes configured to attach a hydraulic cylinder with rod to mounting location 512. The rod will have a valve poppet that will match the valve seat in a way that when pressed together prevents the flow of fluid, even pressurized fluid, from passing across. Therefore, the valve poppet and seat assembly may be configured to significantly reduce or stop the flow of fluid when closed or allow the flow of fluid when open. The valve poppet and seat assembly may also be configured such that each end of the flow path through the valve include a machined connection port to allow the coupling of piping that can be sealed to prevent leakage under pressure. Leakage may be reduced using a flange face, O-ring boss, and/or pipe threads. The valve is bi-directional such that fluid can flow through it in either direction.

Figure 6:
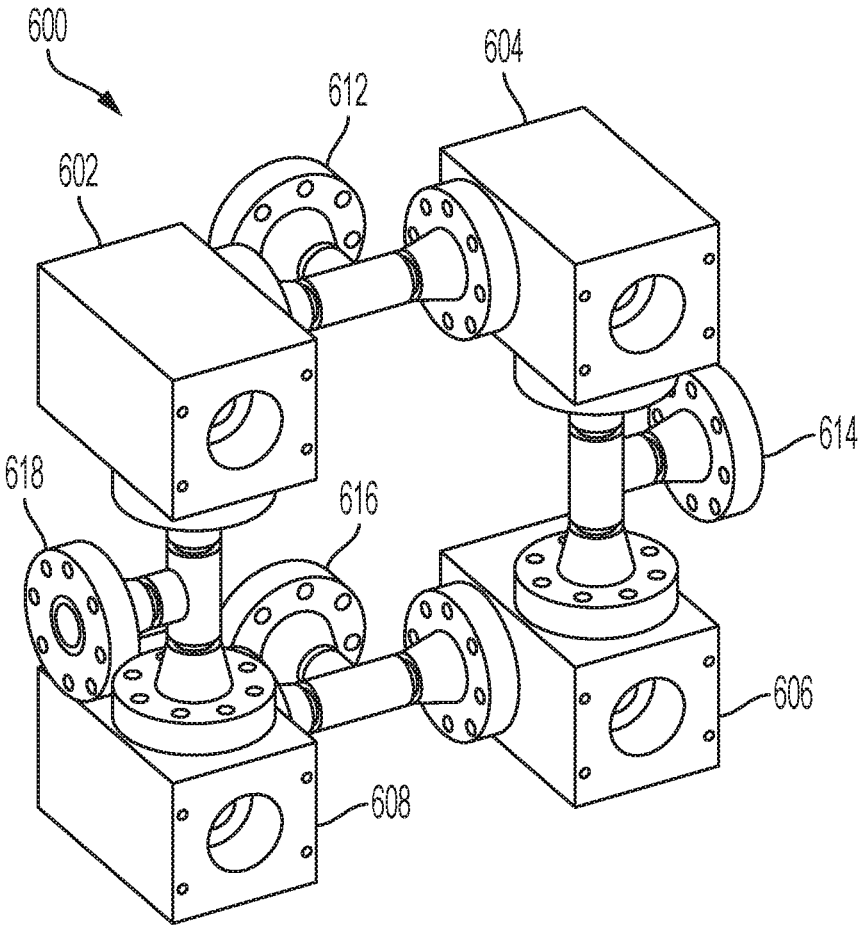
FIG. 6 shows an illustration of a modular valve system having four valves interconnected together to provide two distinct flow paths according to embodiments of the disclosure.

One or more of the valves shown in FIG. 5 may be attached together by piping to form a modular valve system, such as shown in FIG. 6. FIG. 6 shows an illustration of a modular valve system having four valves interconnected together to provide two distinct flow paths according to embodiments of the disclosure. Although the inner components of the individual blocks are not shown, the individual blocks of the embodiment of FIG. 6 may be configured similarly to that shown in FIG. 5. Piping between the blocks may be configured to couple fluid inlets and fluid outlets of various valves to provide desired fluid paths when operated accordingly by hydraulic cylinders.

In one embodiment, four valves are coupled to provide two distinct flow paths, however more or less valves may be coupled. The two distinct flow paths may be used, for example to couple to a low-pressure path for receiving slurry and a high-pressure path for receiving clear fluid to push a slurry mixture to a destination. With four valves configured to provide two distinct flow paths, the modular valve system may include a first valve with a first fluid inlet and a first fluid outlet, a second valve with a second fluid inlet and a second fluid outlet, a third valve with a third fluid inlet and a third fluid outlet, and a fourth valve with a fourth fluid inlet and a fourth fluid outlet. Piping is used to couple the inlets and outlets of the various valves. In one embodiment, first piping is coupled to the first fluid outlet and to the second fluid outlet, second piping coupled to the first fluid inlet and the third fluid inlet, third piping coupled to the third fluid outlet and the fourth fluid outlet, and fourth piping coupled to the fourth fluid inlet and the second fluid inlet.

One advantage of the modular valve system may be having singular valves working separately or together to create a greater flexibility for the system. As pressure requirements increase (e.g., from 5,000 psi to 10,000 psi, and to 15,000 psi), combined flow manifolds also increase in size. This size can become large enough that the blocks of material become difficult to obtain or must be custom forged. Individual valves may create smaller blocks to build that can readily be found at material suppliers. This decreases cost and construction time of the valve systems. Individual valves are also lighter and easier to mount in systems.

Another advantage of the modular valve system may be that use of individual valves can allow them to be placed in different locations to streamline construction of the equipment. For example, the valves could be remotely mounted to the low-pressure slurry feed or low-pressure water line back to the slurry tank. This would use less piping by not requiring the fluid to flow to a centrally-located manifold, thus creating a more efficient piping layout that increases performance (by reducing wear) and is more cost effective (by reducing total piping length). The high-pressure slurry output or water feed lines could also benefit from these remote valves.

The described methods are generally set forth in a logical flow of steps. As such, the described order and labeled steps of representative figures are indicative of aspects of the disclosed method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The operations described above as performed by a controller may be performed by any circuit configured to perform the described operations. Such a circuit may be an integrated circuit (IC) constructed on a semiconductor substrate and include logic circuitry, such as transistors configured as logic gates, and memory circuitry, such as transistors and capacitors configured as dynamic random access memory (DRAM), electronically programmable read-only memory (EPROM), or other memory devices. The logic circuitry may be configured through hard-wire connections or through programming by instructions contained in firmware. Further, the logic circuitry may be configured as a general-purpose processor (e.g., CPU or DSP) capable of executing instructions contained in software. The firmware and/or software may include instructions that cause the processing of signals described herein to be performed. The circuitry or software may be organized as blocks that are configured to perform specific functions. Alternatively, some circuitry or software may be organized as shared blocks that can perform several of the described operations.

If implemented in firmware and/or software, functions described above, such as for controlling sequencing the control of opening and closing high-pressure valves, high-pressure pumps, and low-pressure pumps, may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise random access memory (RAM), read-only memory (ROM), electrically-erasable programmable read-only memory (EEPROM), compact disc read-only memory (CD-ROM) or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and Blu-ray discs. Generally, disks reproduce data magnetically, and discs reproduce data optically. Combinations of the above should also be included within the scope of computer-readable media.

Although the present disclosure and certain representative advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A modular valve system, comprising:

a first valve block, comprising:

a block of material, the block comprising a fluid channel that extends from a first fluid inlet to a first fluid outlet; and a valve seat attached to the fluid channel, wherein the valve seat is configured to prevent flow of fluid into the fluid channel when a valve poppet is pressed against the valve seat;

a second valve block comprising a second fluid inlet and a second fluid outlet;

first piping coupling the first fluid outlet to the second fluid outlet;

a third valve block comprising a third fluid inlet and a third fluid outlet;

a fourth valve block comprising a fourth fluid inlet and a fourth fluid outlet;

second piping coupled to the first fluid inlet and the third fluid inlet;

third piping coupled to the third fluid outlet and the fourth fluid outlet; and fourth piping coupled to the fourth fluid inlet and the second fluid inlet.

2. The modular valve system of claim 1, wherein the valve block comprises a material that is abrasive-resistant.

3. The modular valve system of claim 1, wherein the valve block comprises a bi-directional valve seat.

4. The modular valve system of claim 1, wherein the first valve block comprises a first connection port coupled to the first fluid inlet, the first connection port comprising a seal configured to prevent leakage of fluid from the fluid channel out of the first fluid inlet.

5. The modular valve system of claim 1, wherein the block of material comprises a hydraulic cylinder mounting location configured to receive a hydraulic cylinder to press the valve seat against the valve poppet to prevent flow of fluid into the fluid channel.

6. An apparatus, comprising:

a hopper;

a slurry mixing apparatus coupled to the hopper and configured to mix a low-pressure slurry using material in the hopper;

a first high-pressure valve coupled to the slurry mixing apparatus;

a second high-pressure valve coupled to the slurry mixing apparatus;

a first high-pressure vessel coupled to the slurry mixing apparatus through the first high-pressure valve and the second high-pressure valve;

a third high-pressure valve;

a high-pressure pump coupled to the first high-pressure vessel through the third high-pressure valve, wherein the high-pressure pump is configured to pressurize the first high-pressure vessel; and a fourth high-pressure valve coupled to the first high-pressure vessel and configured to couple the first high-pressure vessel to a destination.

7. The apparatus of claim 6, wherein the first high-pressure valve, the second high-pressure valve, the third high-pressure valve, and the fourth high-pressure valve comprise a modular valve system.

8. The apparatus of claim 6, further comprising a fifth high-pressure valve coupled to the high-pressure pump and coupled to a bypass line for transporting clear fluid around the first high-pressure vessel.

9. The apparatus of claim 6, wherein the slurry mixing apparatus comprises a slurry container and a low-pressure abrasive pump coupled to the slurry container, wherein the low-pressure abrasive pump comprises abrasive-resistant materials, and wherein the slurry container is configured to mix dry sand from the hopper with one or more fluids.

10. The apparatus of claim 6, further comprising a second high-pressure vessel in parallel with the first high-pressure vessel and coupled to the first high-pressure valve, the second high-pressure valve, the third high-pressure valve, and the fourth high-pressure valve.

11. The apparatus of claim 6, further comprising:

a second high-pressure vessel;

a fifth high-pressure valve coupled to the second high-pressure vessel and coupled to slurry mixing apparatus;

a sixth high-pressure valve coupled to the second high-pressure vessel and coupled to slurry mixing apparatus;

a seventh high-pressure valve coupled to the second high-pressure vessel and coupled to the high-pressure pump; and an eighth high-pressure valve coupled to the second high-pressure vessel.

12. The apparatus of claim 6, further comprising a controller coupled to the first high-pressure valve, the second high-pressure valve, the third high-pressure valve, and the fourth high-pressure valve.

13. The apparatus of claim 12, wherein the controller is configured to perform steps comprising:

opening the first high-pressure valve and the second high-pressure valve to circulate low-pressure abrasive slurry from a slurry-mixing apparatus to the first high-pressure vessel;

closing the third high-pressure valve and the fourth high-pressure valve to stop flow of high-pressure non-abrasive fluid through the first high-pressure vessel;

closing the first high-pressure valve and the second high-pressure valve to stop low-pressure flow of abrasive slurry into the first high-pressure vessel; and opening the third high-pressure valve and the fourth high-pressure valve to allow the high-pressure non-abrasive fluid to push the abrasive slurry through the first high-pressure vessel to a destination.

14. A method, comprising:

opening a first high-pressure valve and a second high-pressure valve to create a path for circulating abrasive slurry from a slurry-mixing apparatus to a first high-pressure vessel;

closing a third high-pressure valve and a fourth high-pressure valve to disconnect the first high-pressure vessel from a high-pressure non-abrasive pump;

closing the first high-pressure valve and the second high-pressure valve to disconnect the first high-pressure vessel from the slurry-mixing apparatus; and opening the third high-pressure valve and the fourth high-pressure valve to allow the high-pressure non-abrasive pump to use high-pressure non-abrasive fluid to push the abrasive slurry through the first high-pressure vessel to a destination.

15. The method of claim 14, further comprising controlling a plurality of hydraulically-actuated cylinders to operate the first high-pressure valve, the second high-pressure valve, the third high-pressure valve, and the fourth high-pressure valve.

16. The method of claim 14, further comprising:

opening a fifth high-pressure valve to direct the high-pressure non-abrasive fluid to the destination through a bypass path around the first high-pressure vessel, wherein the opening of the fifth high-pressure valve is before closing the third high-pressure valve and the fourth high-pressure valve; and closing a fifth high-pressure valve to disconnect the bypass path from the high-pressure non-abrasive pump after opening the third high-pressure valve and the fourth high-pressure valve.

17. The method of claim 14, wherein opening the first high-pressure valve and the second high-pressure valve also circulates low-pressure abrasive slurry from a slurry-mixing apparatus to a second high-pressure vessel coupled in parallel with the first high-pressure vessel.

18. The method of claim 17, further comprising:

opening a fifth high-pressure valve and a sixth high-pressure valve, each coupled to the second high-pressure vessel and coupled to the slurry mixing apparatus, to create a path for circulating abrasive slurry from the slurry-mixing apparatus to the second high-pressure vessel;

closing a seventh high-pressure valve and an eighth high-pressure valve, each coupled to the second high-pressure vessel and coupled to the high-pressure non-abrasive pump, to disconnect the second high-pressure vessel from the high-pressure non-abrasive pump;

closing the fifth high-pressure valve and the sixth high-pressure valve to disconnect the second high-pressure vessel from the slurry-mixing apparatus; and opening the seventh high-pressure valve and the eighth high-pressure valve to allow the high-pressure non-abrasive pump to use high-pressure non-abrasive fluid to push the abrasive slurry through the second high-pressure vessel to the destination.

19. The method of claim 18, wherein the opening of the seventh high-pressure valve and the eighth high-pressure valve is performed before closing the third high-pressure valve and the fourth high-pressure valve.

* * * * *